US005329863A

United States Patent [19]

Rasmussen et al.

[11] Patent Number: 5,329,863

[45] Date of Patent: Jul. 19, 1994

[54] TABLE

[75] Inventors: Preben Rasmussen, Galten; Per Hånsbæk, Højbjerg, both of Denmark

[73] Assignee: Skovby Mobelfabrik A/S, Galten, Denmark

[21] Appl. No.: 988,931

[22] PCT Filed: Oct. 16, 1991

[86] PCT No.: PCT/DK91/00314

§ 371 Date: Mar. 11, 1993

§ 102(e) Date: Mar. 11, 1993

[87] PCT Pub. No.: WO92/06613

PCT Pub. Date: Apr. 30, 1992

[30] Foreign Application Priority Data

Oct. 17, 1990 [DK] Denmark ..... 2507/90

[51] Int. Cl.[5] ..... A47B 1/06

[52] U.S. Cl. ..... 108/86; 108/67

[58] Field of Search ..... 108/66, 86, 59, 65, 108/67, 83, 84, 85, 86

[56] References Cited

U.S. PATENT DOCUMENTS 1,003,490 9/1911 Napoli ..... 108/67
1,580,664 8/1928 Cleveland ..... 108/67
5,156,095 10/1992 Hansbaek et al. ..... 108/66

FOREIGN PATENT DOCUMENTS 3143894 5/1983 Fed. Rep. of Germany .
3303670 12/1984 Fed. Rep. of Germany .
2447695 10/1980 France ..... 108/84

*Primary Examiner*—Kenneth J. Dorner
*Assistant Examiner*—Gerald Anderson
*Attorney, Agent, or Firm*—Scully, Scott, Murphy & Presser

[57] ABSTRACT

A table with table leaves displaceable away from one another so as to extend the table area, and with additional leaves (6, 7) which are hingedly interconnected and stored in a folded condition in a storing chamber situated centrally below the table when the table leaves are in the non-extended condition. The additional leaves (6, 7) are connected to a vertically displaceable carrying member (11) in turn connected to a driving means (22). Guide means (12) are provided in connection with the additional leaves (6, 7), said guide means supporting each additional leaf (6, 7) at a substantially fixed and relatively short distance from the hinged rims (8, 9) thereof substantially along the entire moving path thereof.

4 Claims, 2 Drawing Sheets

TABLE

TECHNICAL FIELD

The invention relates to a table with table leaves displaceable away from one another so as to extend the table area, and with additional leaves which are hingedly interconnected and adapted to be placed between said table leaves when the latter are in the extended position, and where said additional leaves are stored in a folded condition in a storing chamber situated centrally below the table when the table leaves are in the non-extended condition, i.e. when the table leaves abut one another, said additional leaves being connected to a vertically displaceable carrying member in turn connected to a driving means.

BACKGROUND ART

Tables with additional leaves are known where the additional leaves are stored in a centrally situated storing chamber when the table is not extended, and where the moving of the additional leaves in and out of the storing chamber is facilitated by means of driving means, such as counterweights.

DISCLOSURE OF INVENTION

The object of the invention is to provide a table where the moving of the additional leaves in and out of the storing chamber can be performed in a relatively easy and gentle manner.

The table according to the invention is characterised in that guide means are provided which support each additional leaf at a substantially fixed and relatively short distance from the hinged rims thereof substantially along the entire moving path thereof.

In this manner a table is provided where the moving of the additional leaves in and out of the centrally situated storing chamber can be performed in a relatively smooth and convenient manner. The latter is due to the fact that the unfolding is supported by the weight of the additional leaves at the same time as the additional leaves are supported by the guide means in any unfolding angle.

According to the invention the guide means of each additional leaf may comprise at least one connecting member hingedly connected both to the bottom side of the additional leaf in question and to the displaceable carrying member substantially vertically below the hinged connection to the associated additional leaf when the additional leaves are folded, both hinged connections comprising axes of rotation extending parallel to the hinged rims of the additional leaves. As a result, a particularly simple embodiment of the invention is obtained where the hinged connection of the connecting members on the additional leaves follow a circular path relative to the supporting member in a direction substantially perpendicular to the moving direction of the supporting member.

According to the invention the connecting members may be subjected to a biasing means subjecting the hinged connections of the additional leaves to a biasing force in a direction opposite the unfolding movement with the result that the unfolding movement of the additional leaves is particularly gentle.

A particularly preferred embodiment of the invention is characterised in that the connecting members are portions of U-shaped members made of spring steel, where the body of the U-shaped member is secured to the carrying member and where the legs present the connecting members.

BRIEF DESCRIPTION OF DRAWINGS

The invention is described in greater detail below with reference to the accompanying drawings, in which.

BEST MODE FOR CARRYING OUT THE INVENTION

Figure 1:
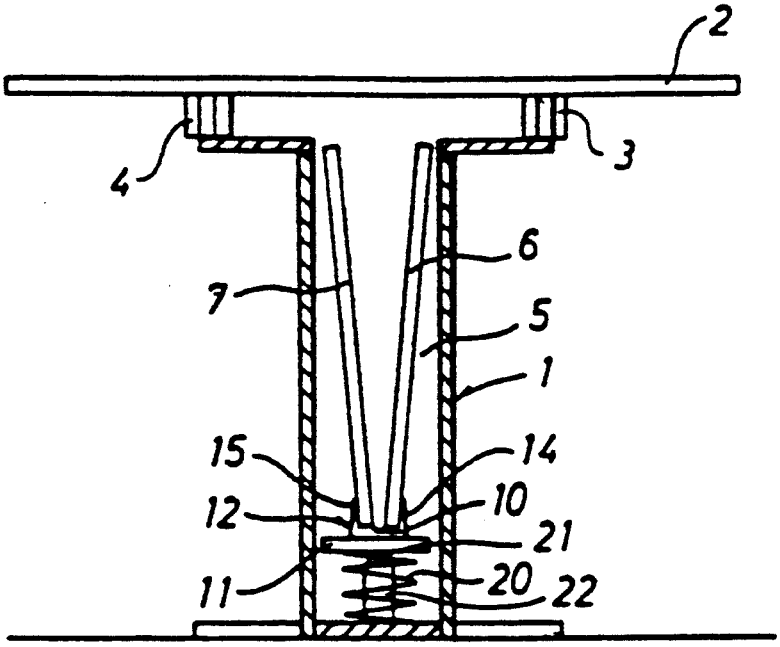
FIG. 1 is a diagrammatical side view of a table according to the invention, and a vertical sectional view of a centrally situated storing chamber for the additional leaves, where the table is not extended and the additional leaves are stored in the centrally situated storing chamber, FIG. 2 corresponds to FIG. 1, but where the additional leaves are inserted between displaced table leaves in the extended position of the table, and FIG. 3 on a larger scale portions of the table of FIG. 1.

The table of FIG. 1 comprises a central base designated the general reference numeral 1. Table leaves 2 are mounted on the base 1 and can be pulled away from one another in a direction perpendicular to the plane of the drawing away from a central center line while guided by the guiding means 3 and 4 of a conventional type found in extension tables. The base 1 comprises a centrally situated storing chamber 5 for two hingedly interconnected collapsible additional leaves 6 and 7. The additional leaves 6 and 7 are hingedly interconnected along adjacent hinged rims 8 and 9, cf. FIG. 3, by means of a number, preferably two, of folding hinges 10 of a conventionally known type. The folding hinges allow a folding of the additional leaves 6, 7 into the state shown in FIGS. 1 and 3 as well as an unfolding of said leaves so that said additional leaves are on the same plane with their hinge rims closely abutting one another.

Figure 3:
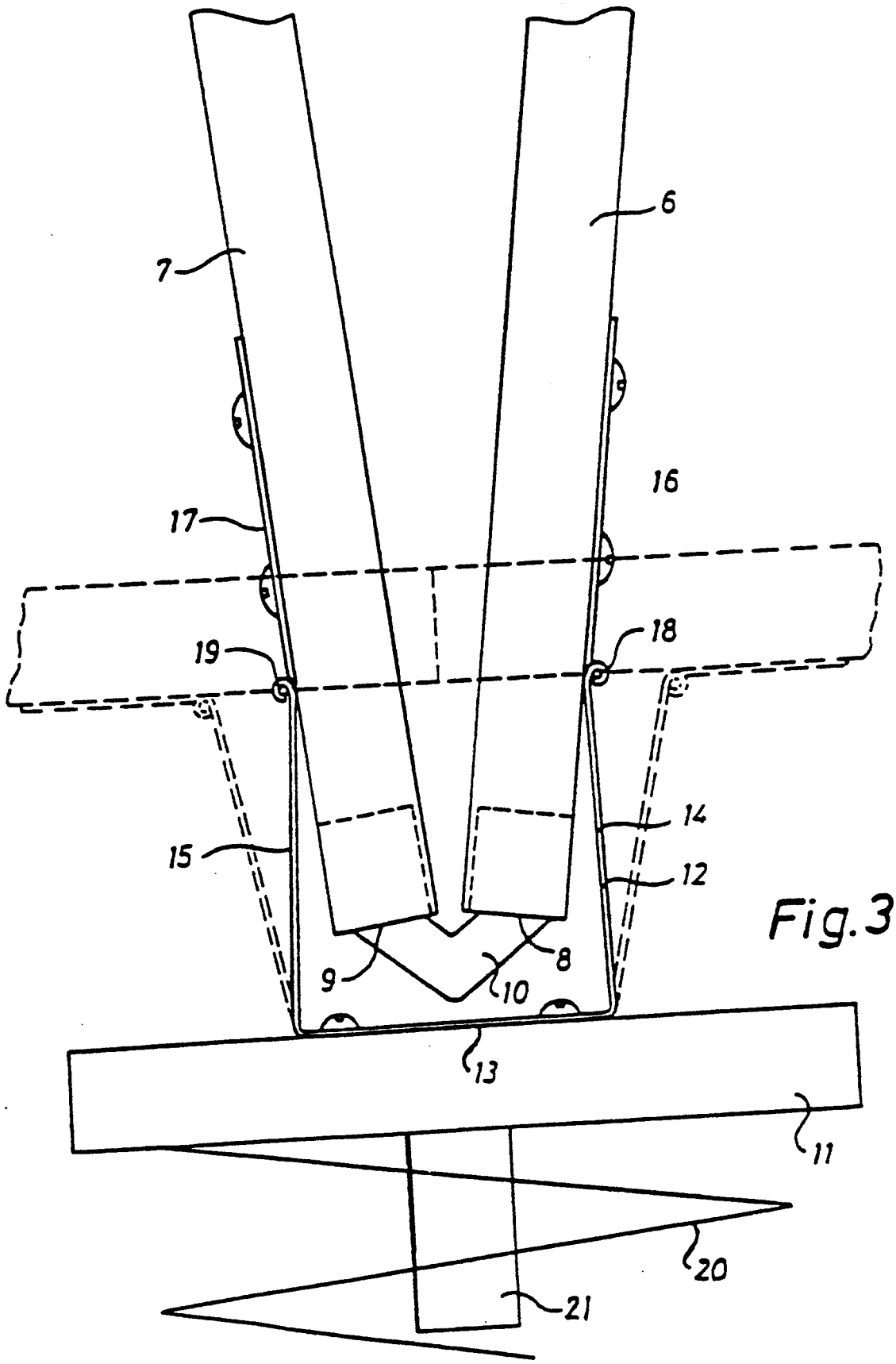

As clearly illustrated in FIG. 3, the additional leaves 6, 7 are secured to a carrying plate 11 by means of a number, preferably two, of U-shaped hinge members 12. The body of the U-shaped hinge members 12 is screwed onto the carrying plate 11, whereas the legs 14 and 15 of said hinge members extend symmetrically about a vertical central plane and upwards to the bottom side of their respective additional leaf 6, 7. A hinged connection is formed between the hinge member 12 and each additional leaf 6 and 7 by means of the free ends of the legs 14 and 15 and an adjacent end of a respective fitting 16, 17 screwed onto the bottom side of the additional leaves 6, 7. The hinge connections 18, 19 in question provide an axis of rotation relative to the carrying plate 11 for each additional leaf 6, 7. The axis of rotation is situated relatively close to the hinge rims 8 and 9 and extends parallel thereto and symmetrically about the vertical central plane between the additional leaves 6, 7.

The hinge member 12 is made of plate-shaped spring steel and is preferably of a width of approximately 50 mm, whereas each leg 14, 15 is of a length of approximately 70 mm. The rotating connections 18, 19 are thus arranged relatively close to the hinge rims 8, 9.

Figure 2:
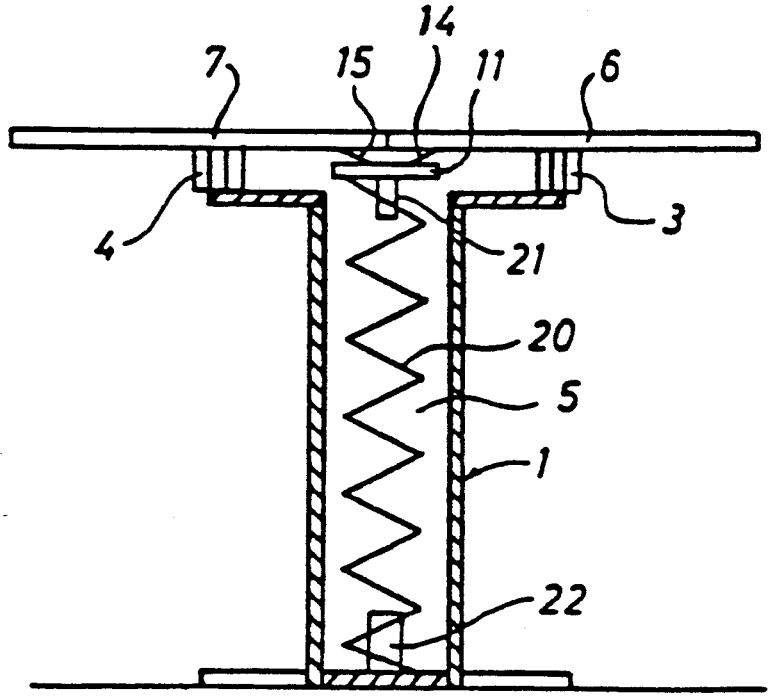

The carrying plate 11 is supported by a helical spring 20 extending to the bottom of the storing chamber 5. The helical spring 20 is dimensioned such relative to the weight of the additional leaves 6 and 7 and the carrying plate 11 that the latter parts are subjected to an upward expelling force slightly exceeding the weight of said parts when they are stored in the storing chamber 5, whereas they are subjected to a downward force when they are in the unfolded position indicated in FIG. 2.

A downward pin 21 is provided on the bottom side of the carrying plate 11. The pin is adapted to engage a locking device 22 of a conventionally known type in the bottom of the storing chamber 5 by means of parts not described in greater detail. The locking device co-operates with the pin 21 in retaining the folded additional leaves 6, 7 in the storing chamber 5 until said additional leaves are to be used. When the additional leaves are to be used, a slight pressing on one of the additional leaves 6, 7 causes a disengagement of the locking connection.

When the additional leaves 6, 7 are to be used, the table leaves 2 are pulled away from one another. Subsequently, the additional leaves 6, 7 are pulled out of the storing chamber 5 upon disengagement of the lock of the locking device 22. The pulling out movement is facilitated by the spring 20 initially pressing the additional leaves 6, 7 a short distance upwards and out of the storing chamber 5. During the pulling out movement the additional leaves 6, 7 are unfolded partly by way of their own weight and while turning about the hinge connections 18, 19. The legs 14, 15 of the hinge members 12 yield until the additional leaves 6, 7 are on the same plane, cf. the dotted lines in FIG. 3 and the solid lines in FIG. 2. The unfolding of the additional leaves 6, 7 is carried out in a gently and convenient manner because of the resilient properties of the hinge members 12. The last step of the pulling out movement from the storing chamber 5 and the unfolding movement take place while the spring 20 is subjected to a pulling in such a manner that in turn it subjects the additional leaves to a slight biasing force tn a downward direction so as to facilitate a later folding movement.

When the additional leaves 6, 7 are correctly inserted so as to flush with one another between the table leaves 2, the table leaves are pressed together so as to abut the additional leaves 6, 7 and to retain the latter between the table leaves.

When the additional leaves are to be removed again, the table leaves 2 are caused to disengage the additional leaves 6, 7, and a lifting of one of the additional leaves activates the folding and returning movement of said additional leaves 6, 7 to the storing chamber 5 while assisted by the spring 20. The last step of the correct storing of the additional leaves in the storing chamber 5 is carried out by said additional leaves 6, 7 being subjected to a slight pressure until the pin 21 of the carrying plate 11 has engaged the locking device 22.

The invention has been described with reference to a preferred embodiment. Many modifications may, however, be carried out without thereby deviating from the scope of the invention. Other driving means may for instance be used beyond the spring mentioned, and the hinge member 12 can be replaced by connecting members forming a connection between the hinge connections 18 and 19 and a hinging on the carrying plate 11, whereby the resulting connection is placed almost vertically below the hinge connections 18, 19 when the additional leaves are folded.

We claim:

1. A table with table leaves defining a table area when said leaves are in a first retracted position, said table leaves being displaceable away from one another in a second extended position and having additional leaves which are hingedly interconnected and adapted to be unfolded between said table leaves for abutting said table leaves when said table leaves are in said second extended position to extend said table area, each said additional leaves having hinged rim portions (8,9) thereof and stored in a folded condition in a storing chamber situated centrally below the table, said additional leaves being additionally connected to a vertically displaceable carrying member (11) for moving said leaves in said folded condition vertically along a moving path defined by said storing chamber; said table further including guide means (12) having at least one connecting member (14,15) for supporting each additional leaf (6, 7) at a substantially fixed and relatively short distance from said hinged rim portions (8, 9) thereof, each said at least one connecting member (14, 15) hingedly connected at a first end to a bottom side of a respective one of said additional leaves to thereby form hinged connections (18,19) thereat, and connected at a second end to said displaceable carrying member (11) at a location substantially vertically below said hinged connection (18, 19) of each respective additional leaf (6, 7) when said additional leaves (6, 7) are in said folded condition, both said hinged connections (18,19) defining axes of rotation extending parallel to said hinged rims (8, 9) of said additional leaves (6, 7).

2. The table as claimed in claim 1, characterized by driving means (20) for moving said carrying member and said additional leaves in said folded condition vertically along a moving path.

3. A table as claimed in claim 1, characterized in that said additional leaves are each unfolded in a direction about said axes of rotation of said hinged connections, said connecting members are subjected to a biasing force such that the hinged connections of the additional leaves are biased in a direction opposite the unfolded direction.

4. A table as claimed in claim 1, characterized in that the guide means (12) further includes a body member (13), wherein said body member (13) and said connecting members (14,15) define a U-shaped member made of spring steel, where the body (13) of the U-shaped member is secured to the carrying member and the connecting members (14,15) represent legs of the U-shaped member.

* * * * *